US011111775B2

(12) United States Patent
Levchak et al.

(10) Patent No.: US 11,111,775 B2
(45) Date of Patent: Sep. 7, 2021

(54) WEAR SLEEVE

(71) Applicant: Halliburton Energy Services, Inc., Houston, TX (US)

(72) Inventors: Michael J. Levchak, Tomball, TX (US); Alexei Korovin, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 84 days.

(21) Appl. No.: 16/623,298

(22) PCT Filed: Aug. 2, 2017

(86) PCT No.: PCT/US2017/045130
§ 371 (c)(1),
(2) Date: Dec. 16, 2019

(87) PCT Pub. No.: WO2019/027455
PCT Pub. Date: Feb. 7, 2019

(65) Prior Publication Data

US 2020/0232314 A1 Jul. 23, 2020

(51) Int. Cl.
*E21B 47/017* (2012.01)
*E21B 17/10* (2006.01)

(52) U.S. Cl.
CPC ..... *E21B 47/017* (2020.05); *E21B 17/10* (2013.01)

(58) Field of Classification Search
CPC .... E21B 17/01; E21B 17/046; E21B 17/1078; E21B 47/017
See application file for complete search history.

(56) References Cited

U.S. PATENT DOCUMENTS 1,854,339 A * 4/1932 Lamb ..... E21B 17/105 175/325.6
2,943,009 A * 6/1960 Mirsky ..... E21B 17/1042 264/259
4,796,670 A 1/1989 Russell et al.
4,815,770 A 3/1989 Hyne et al.
5,212,495 A 5/1993 Winkel et al.
(Continued)

FOREIGN PATENT DOCUMENTS

WO 2016067184 A1 5/2016
WO 2019027455 A1 2/2019

OTHER PUBLICATIONS

Foreign communication from the priority International Application No. PCT/US2017/045130, International Search Report and Written Opinion, dated Jan. 30, 2018, 12 pages.
(Continued)

*Primary Examiner* — Giovanna Wright
(74) *Attorney, Agent, or Firm* — Conley Rose, P.C.; Rodney B. Carroll

(57) ABSTRACT

A wearable sleeve to protect a sensor coupled to an object. The wearable sleeve having an axial axis, a longitudinal axis substantially perpendicular to the axial axis, a first wearable sleeve end and a second wearable sleeve end opposite the first wearable sleeve end. A first ring coupled to the first end of the first wearable sleeve end and a second ring coupled to the second wearable sleeve end. The first ring and the second ring have the same expansion properties as the object.

23 Claims, 12 Drawing Sheets

(56) References Cited

U.S. PATENT DOCUMENTS

| | | | | |
|---|---|---|---|---|
| 5,767,674 | A * | 6/1998 | Griffin | G01V 3/32 324/303 |
| 6,084,052 | A | 7/2000 | Aufdermarsh et al. | |
| 7,159,654 | B2 | 1/2007 | Ellison et al. | |
| 7,912,678 | B2 | 3/2011 | Denny et al. | |
| 8,097,199 | B2 | 1/2012 | Abbott et al. | |
| 8,119,047 | B2 | 2/2012 | Moore et al. | |
| 9,121,966 | B2 * | 9/2015 | Blanz | G01V 3/32 |
| 2003/0150611 | A1 * | 8/2003 | Buytaert | E21B 17/1028 166/241.6 |
| 2005/0155770 | A1 * | 7/2005 | Parrott | E21B 43/11 166/380 |
| 2005/0161214 | A1 | 7/2005 | Myhre et al. | |
| 2007/0062707 | A1 | 3/2007 | Leising et al. | |
| 2007/0227746 | A1 * | 10/2007 | Xu | E21B 33/1216 166/387 |
| 2012/0126008 | A1 | 5/2012 | Binmore | |
| 2012/0297652 | A1 | 11/2012 | Halvorsen | |
| 2013/0057387 | A1 | 3/2013 | Binmore | |
| 2013/0160993 | A1 * | 6/2013 | Davila | E21B 17/10 166/241.6 |
| 2016/0115765 | A1 | 4/2016 | Braekke et al. | |
| 2018/0163504 | A1 * | 6/2018 | Watson | C09K 8/426 |

OTHER PUBLICATIONS

Foreign communication from International Application No. PCT/IB2015/058250, International Search Report and Written Opinion, dated Jan. 7, 2016, 17 pages.

Foreign Communication from Related Application—Canadian Office Action, Canadian Patent Application No. 3,067,809, dated Feb. 3, 2021, 5 pages.

* cited by examiner

WEAR SLEEVE

CROSS REFERENCE TO RELATED APPLICATIONS

This application is a filing under 35 U.S.C. 371 of International Application No. PCT/US2017/045130 filed Aug. 2, 2017, entitled "Wear Sleeve," which application is incorporated by reference herein in its entirety.

BACKGROUND

Non-conductive fiberglass composite wear sleeves, which may be manufactured from spun glass set in thermosetting polymers such as epoxy, polyester resin, or vinyl ester, have proven to be unreliable due to their limited physical properties under downhole conditions, especially at extreme pressures and extreme temperatures. Such wear sleeves not only provide protection of sensitive parts, such as antennas or sensors, from the formation, they are also useful to seal out drilling fluid/mud from these sensitive parts where desired. The wear sleeves are intended to be replaceable or a consumable, but some last only one run and become expensive wear items. Inexpensively protecting sensitive parts in a downhole environment is a challenge.

DETAILED DESCRIPTION

Figure 1:
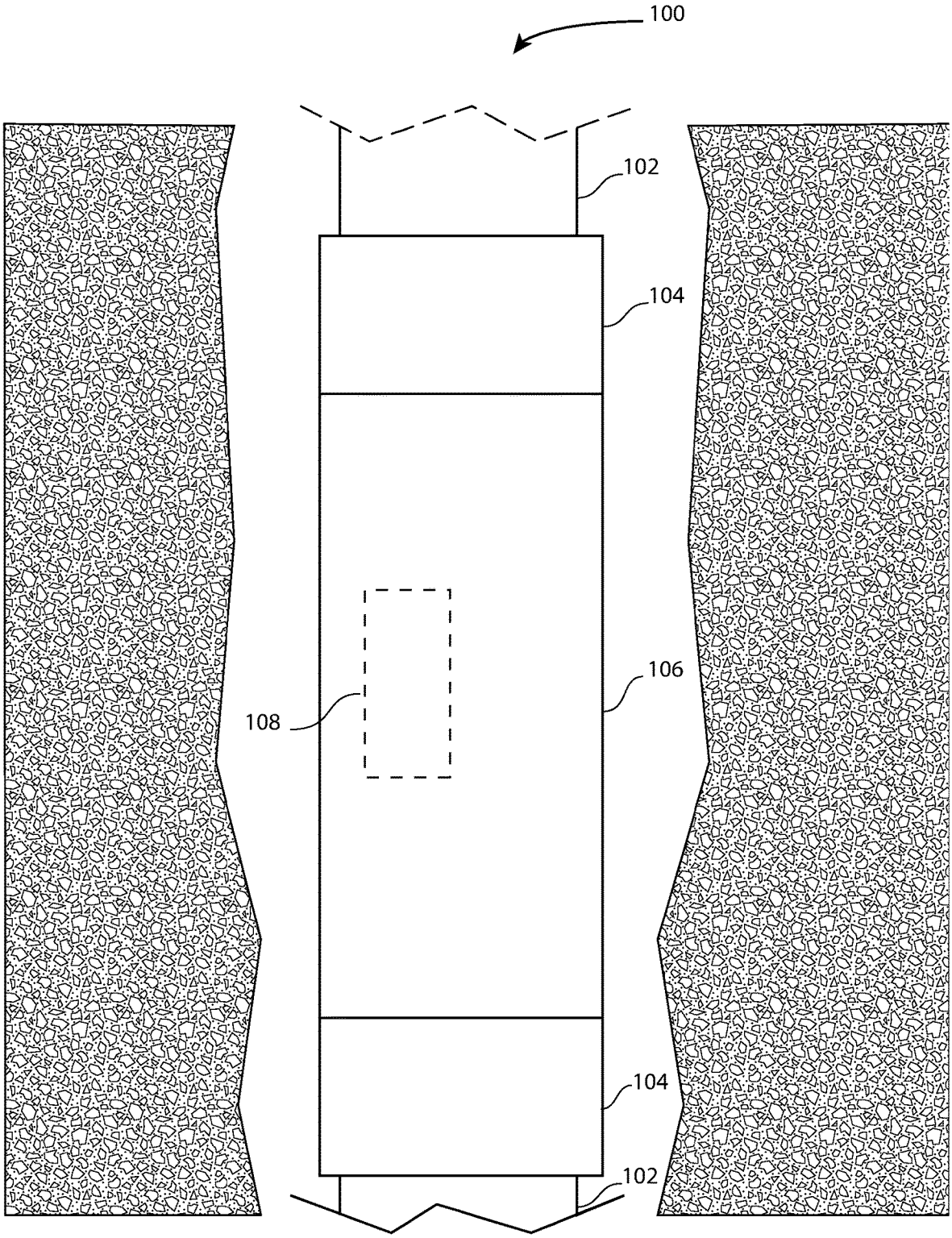
FIG. 1 is a plan view of a bottom hole assembly configuration showing an attached wearable sleeve assembly.

The following detailed description illustrates embodiments of the present disclosure. These embodiments are described in sufficient detail to enable a person of ordinary skill in the art to practice these embodiments without undue experimentation. It should be understood, however, that the embodiments and examples described herein are given by way of illustration only, and not by way of limitation. Various substitutions, modifications, additions, and rearrangements may be made that remain potential applications of the disclosed techniques. Therefore, the description that follows is not to be taken as limiting on the scope of the appended claims. In particular, an element associated with a particular embodiment should not be limited to association with that particular embodiment but should be assumed to be capable of association with any embodiment discussed herein.

In one or more embodiments, a one-piece fiberglass-composite sleeve is replaced with a three-piece wearable sleeve consisting of metal end rings (for sealing) bonded to a center section of the wearable sleeve. The wearable sleeve may be made from chopped fiberglass filled rubber, such as Nitrile butadiene rubber (NBR), VITON®, provided by The Chemours Company FC, LLC, or some other similar material. The rubber material is compliant as compared to the stiffness of the fiberglass composite. The metal end rings allow for a proper seal to a metal tubular component, such as a collar. Because the metal tubular component and the metal end rings are of a similar material, the collar and the metal end rings will expand at relatively the same rate under temperature, which provides a better seal.

There are several options to bonding the metal end rings to the center section of the wearable sleeve to provide a pressure seal between the material of the center section, i.e., composite material, and the metal of the metal end rings. For example, the metal and composite material of the center section can be cured in place through an adhesion promoter. In addition to securing the metal end rings to the composite material, the metal end rings can be configured in numerous ways, such as by adding an O-ring configuration to prevent slippage between one or both of the metal end rings and the center section, thereby maintaining the seal. The metal end rings can provide a better O-ring sealing surface than the composite.

Also, the service or replacement interval for such a wearable sleeve, which is abrasion and impact resistant as well as compliant, should result in improving longer mean time between failure (MTBF) and lower reliability and maintainability (R&M) costs. Further, non-conductive sleeves may be used in tools such as magnetic resonance imaging logging tools to act as a shield for the transmit and receive antennas.

This embodiment allows for greater measurement sensitivity and/or reduced power consumption, thereby improving the ability of logging and measuring while drilling (LMWD) technologies (i.e., resistivity, nuclear magnetic residence, etc.) to map reservoir sections and enhance geosteering.

FIG. 1 is a plan view of a bottom hole assembly configuration showing an attached wearable sleeve assembly. The bottom hole assembly 100 includes a tubular 102, such as a drill string, and collars 104 for connecting the tubulars 102. In one or more embodiments, a wearable sleeve assembly 106 is attached to the collar 104. The wearable sleeve assembly 106 may cover a vulnerable portion 108 (i.e., sensors, antennas, etc., shown as the dashed box labeled 108) of the bottom hole assembly 100.

Figure 2:
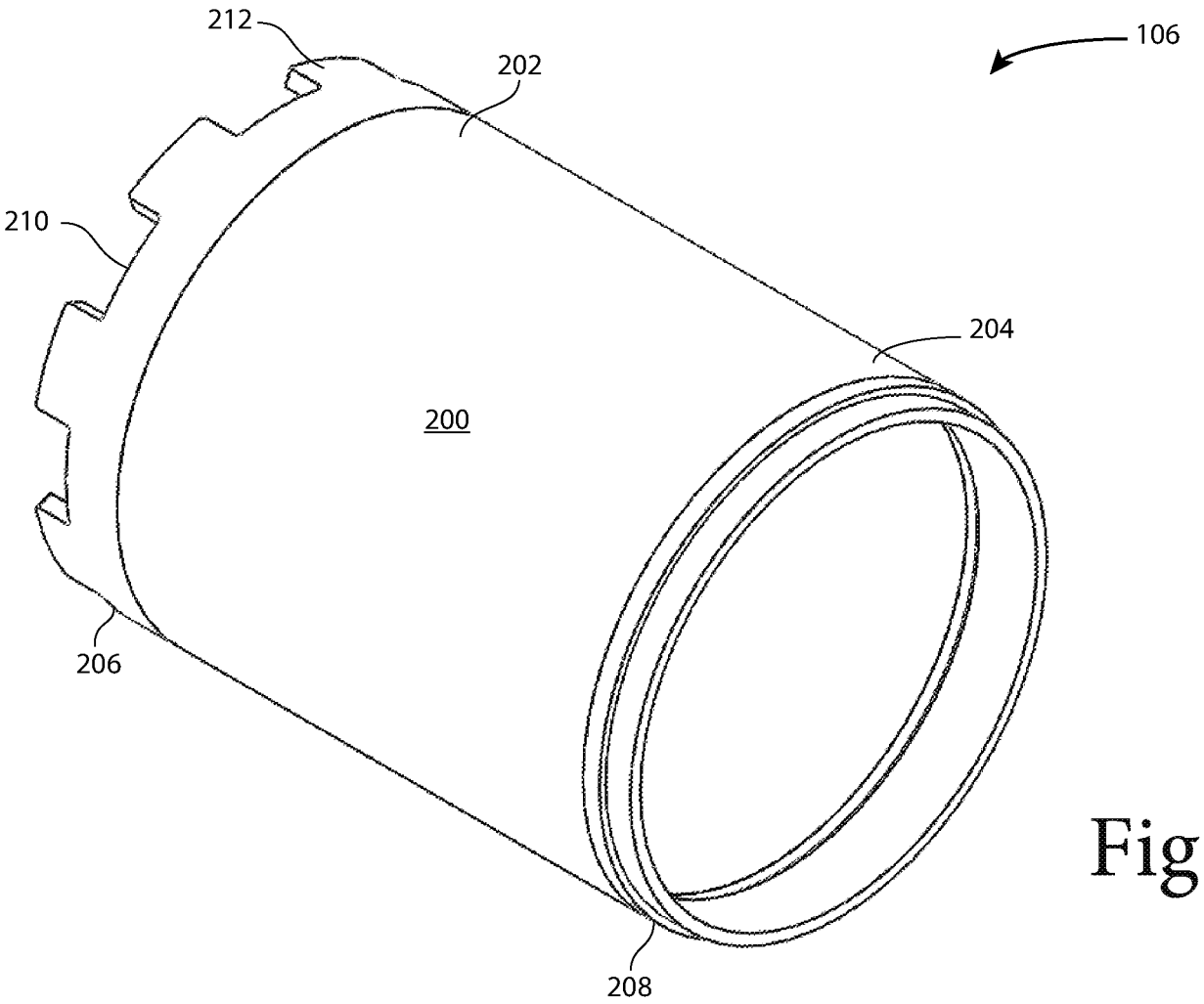
FIG. 2 is a perspective view of a wearable sleeve, a castellated ring, and a seal support.
Figure 3:
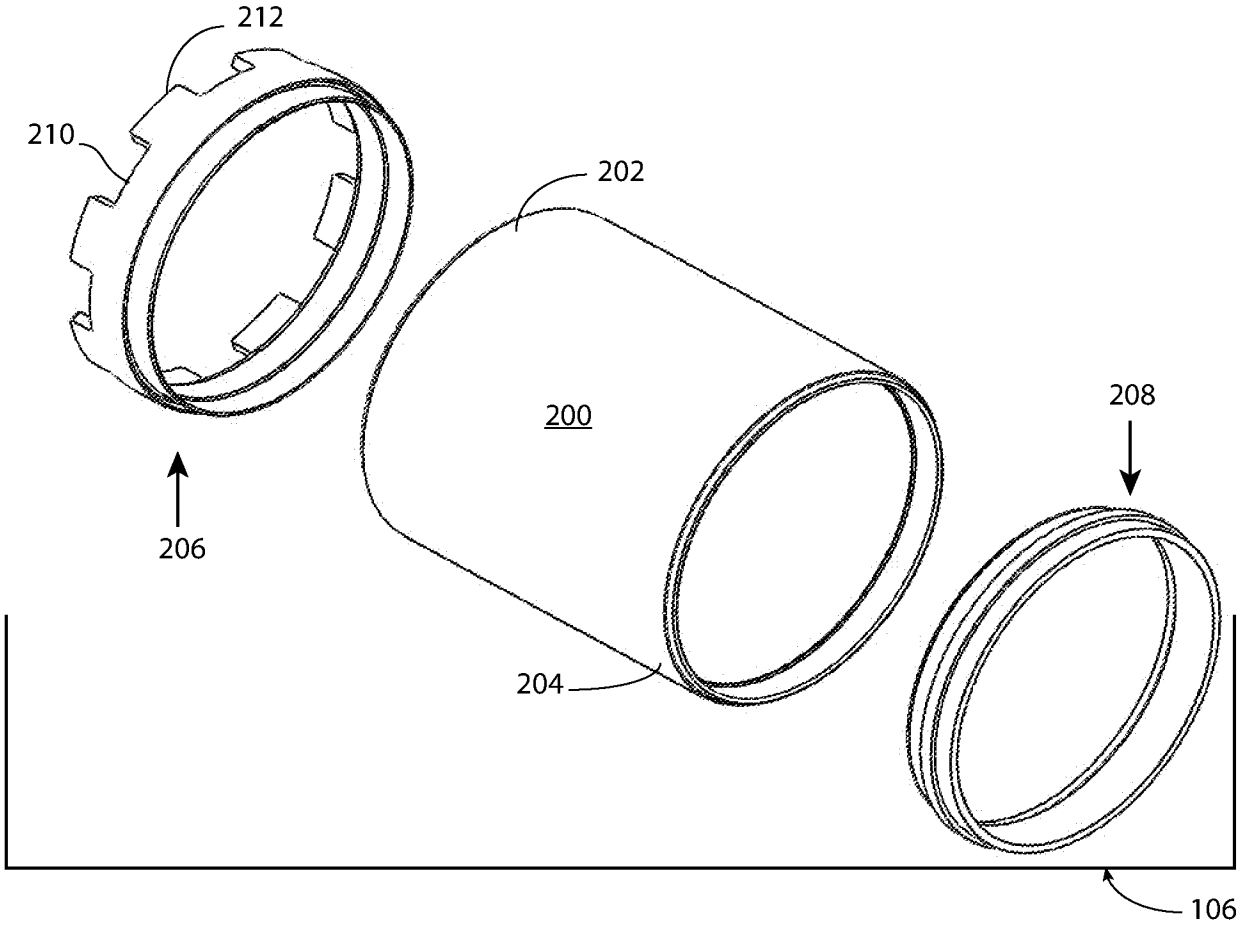
FIG. 3 is an exploded perspective view of the wearable sleeve, the castellated ring, and the seal support of FIG. 2.

FIG. 2 is a perspective view of a wearable sleeve, a castellated ring, and a seal support. FIG. 3 is an exploded perspective view of the wearable sleeve, the castellated ring, and the seal support of FIG. 2. The wearable sleeve assembly 106 includes a wearable sleeve 200. The wearable sleeve 200 may be made from chopped fiberglass filled rubber, such as Nitrile butadiene rubber (NBR), VITON®, provided by The Chemours Company FC, LLC, or some other similar material. The wearable sleeve 200 has a first wearable sleeve end 202 and a second wearable sleeve end 204 opposite the first wearable sleeve end 202.

The wearable sleeve assembly 106 includes two metal end rings, which may include a castellated ring 206 coupled to the first wearable sleeve end 202 and a seal support 208 coupled to the second wearable sleeve end 204. The castellated ring 206 includes a castellated end 210. The castellated end 210 includes a plurality of azimuthally-spaced locking segments 212, which restricts the wearable sleeve 200 from rotating and/or slipping off the collar 104 or any other apparatus the wearable sleeve 106 may be coupled to. One reason to avoid rotation and/or slipping is to protect the vulnerable portion 108 of the bottom hole assembly 100 from being damaged or exposed to the harsh downhole environment. Although the castellated ring 206 in FIG. 2 shows a particular number of locking segments 212, the castellated ring 206 may have a greater or lesser number of locking segments 212 than illustrated. In one or more embodiments, the wearable sleeve 200 may include two castellated rings 206, one coupled to each end (i.e., first wearable sleeve end 202 and second wearable sleeve end 204) of the wearable sleeve 200 or may include two seal supports 208, one coupled to each end (i.e., first wearable sleeve end 202 and second wearable sleeve end 204) of the wearable sleeve 200.

There may be an extrusion gap (not shown) between the castellated ring 206 and the collar 104 and the seal support 208 and the collar 104 to allow for a proper seal between an O-ring and the mating components which restricts fluid from entering the wearable sleeve 106 and thus reaching the vulnerable portions 108 of the bottom hole assembly 100. An extrusion gap is a space created between the inside diameter of one mating component and the outside diameter of another mating component (i.e., between the inside diameter of the castellated ring 206 and the outside diameter of the first wearable sleeve end 202 or between the inside diameter of the seal support 212 and the outside diameter of the second wearable sleeve end 204) when the components are coupled. The extrusion gap is specifically designed such that the O-ring, when pressurized, will seal the extrusion gap preventing fluid from reaching the vulnerable portions 108. If the extrusion gap is too large, the O-ring may be deformed and even damaged so that it no longer seals the extrusion gap properly.

Figure 4:
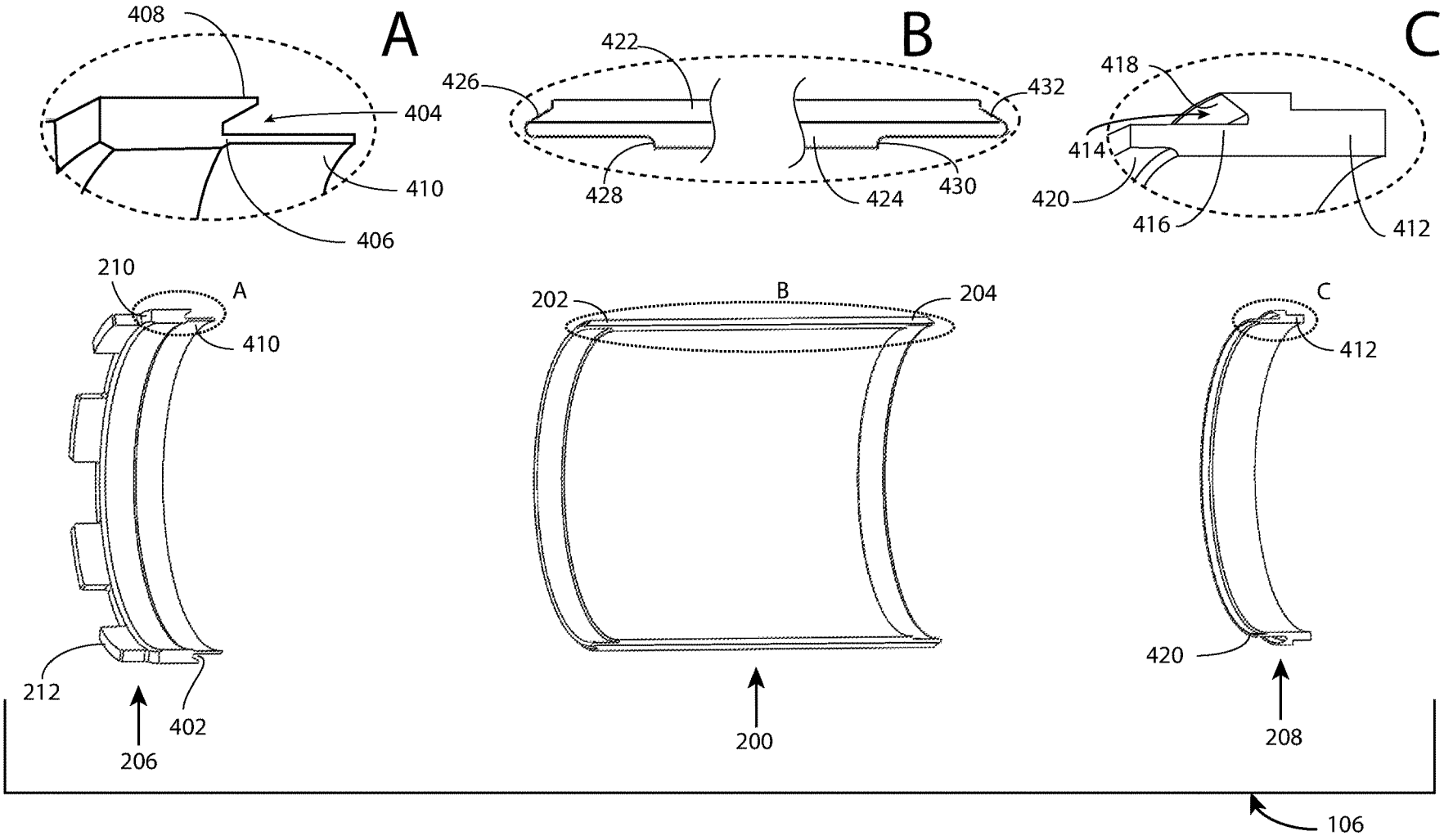
FIG. 4 is an exploded cross-sectional view of the wearable sleeve, the castellated ring, and the seal support of FIG. 2.

FIG. 4 is an exploded cross-sectional view of the wearable sleeve, the castellated ring, and the seal support of FIG. 2. As discussed above in connection with FIGS. 2 and 3, and as indicated in FIG. 4, the castellated ring 206 includes a mating end 402 opposite the castellated end 210. The mating end 402 includes a first groove 404 which faces away from the castellated end 210 of the castellated ring 206. The first groove 404 allows for the insertion of the first wearable sleeve end 202 into the first groove 404. That is, the first wearable sleeve end 202 is inserted into the first groove 404 and sealed.

As illustrated in the highlighted section A of FIG. 4, the castellated ring 206 includes a first inside lip 406, which may be integral to the mating end 402 of the castellated ring 206. The first inside lip 406 couples to the first wearable sleeve end 202. In one or more embodiments, the first inside lip 406 is friction coupled to the first wearable sleeve end 202. In one or more embodiments, the first inside lip 406 is chemically bonded to the first wearable sleeve end 202 by, for example, an adhesion promoter.

The castellated ring 206 includes a first outside lip 408, which may be integral to the mating end 402 of the castellated ring 206. The first outside lip 408 couples to the first wearable sleeve end 202. In one or more embodiments, the first outside lip 408 is chemically bonded to the first wearable sleeve end 202 by, for example, an adhesion promoter.

The castellated ring 206 includes an anti-rotation ring 410, which extends from the first inside lip 406 of the castellated ring 206. In one or more embodiments, the anti-rotation ring 410 is friction coupled to the first wearable sleeve end 202 such that the first groove 404 accepts the first wearable sleeve end 202 and the anti-rotation ring 410 seals against the first wearable sleeve end 202. In one or more embodiments, the anti-rotation ring 410 is chemically bonded to the first wearable sleeve end 202 by, for example, an adhesion promoter.

The wearable sleeve 200 may be coupled to the seal support 208. The seal support 208 includes a first seal ring 412. As illustrated in the highlighted section C of FIG. 4, the first seal ring 412 includes a second groove 414 which faces towards the second wearable sleeve end 204. The second groove 414 allows for the insertion of the second wearable sleeve end 204 into the second groove 414. That is, the second wearable sleeve end 204 is inserted into the second groove 414 and sealed.

The seal support 208 may include a second inside lip 416, which may be integral to the first seal ring 412 of the seal support 208. The second inside lip 416 couples to the second wearable sleeve end 204. In one or more embodiments, the second inside lip 416 is friction coupled to the second wearable sleeve end 204. In one or more embodiments, the second inside lip 416 is chemically bonded to the first wearable sleeve end 202 by, for example, an adhesion promoter.

The seal support 208 includes a second outside lip 418, which may be integral to the first seal ring 412 of the seal support 208. The second outside lip 418 couples to the second wearable sleeve end 204. In one or more embodiments, the second outside lip 418 is chemically bonded to the second wearable sleeve end 204 by, for example, an adhesion promoter.

The seal support 208 includes a second seal ring 420, which may be integral to and extend from the second inside lip 416 of the seal support 208. In one or more embodiments, the second seal ring 420 is friction coupled to the second wearable sleeve end 204 such that the second groove 414 accepts the second wearable sleeve end 204 and the second seal ring 420 seals against the second wearable sleeve end 204. In one or more embodiments, the second seal ring 420 is chemically bonded to the second wearable sleeve end 204 by, for example, an adhesion promoter.

As illustrated in the highlighted section B of FIG. 4, the wearable sleeve 200 includes a first material layer 422 overlaid on a second material layer 424. In one more embodiments, the second material layer 424 is overlaid on the first material layer 422. Although, FIG. 4 illustrates two material layers (i.e., first material layer 422 and second material layer 424) the wearable sleeve 200 may have a larger number (e.g., three or more) of material layers or only one layer of integrated material (i.e, chopped fiberglass). The first material layer 422 may include wearable material such as chopped fiberglass filled rubber, NBR, VITON® provided by The Chemours Company FC, LLC, or any other like material. The second material layer 424 may include a wearable material such as KEVLAR® provided by du Pont de Nemours and Company, polyester, fiberglass, or any similar material. In one or more embodiments, the first material layer 422 and the second material layer 424 are made from the same material.

In one or more embodiments, the first wearable sleeve end 202 has features that complement the mating features of the castellated ring 206. For example, as illustrated in the highlighted section B of FIG. 4, the first wearable sleeve end 202 may include a first wearable sleeve end lip 426 that extends from the first wearable sleeve end 202 and has the shape of a descending slope. The first wearable sleeve end lip 426 is inserted into the first groove 404 of the castellated ring 206 and provides support to restrain the castellated ring 206 from slipping with respect to the wearable sleeve 200. The first wearable sleeve end 202 may also include a first wearable sleeve end rim 428 located on the inside diameter of the first wearable sleeve end 204 of the wearable sleeve 200. The first wearable sleeve end rim 428 mates against the anti-rotation ring 410 and restrains the castellated ring 206 from slipping with respect to the wearable sleeve 200.

In one or more embodiments, the second wearable sleeve end 204 has features that complement the mating features of the seal support 208. For example, the second wearable sleeve end 204 may include a second wearable sleeve end rim 430 positioned on the inside of the second wearable sleeve end 204 of the wearable sleeve 200. The second wearable sleeve end rim 430 mates against the second seal ring 420 and restrains the seal support 208 from slipping with respect to the wearable sleeve 200. The second wearable sleeve end 204 may also include a second wearable sleeve end lip 432 that extends from the second wearable sleeve end 204 and has the shape of a descending slope. The second wearable sleeve end lip 432 is inserted into the second groove 414 of the seal support 208 and provides additional support to restrain the seal support 208 from slipping with respect to the wearable sleeve 200.

Figure 5:
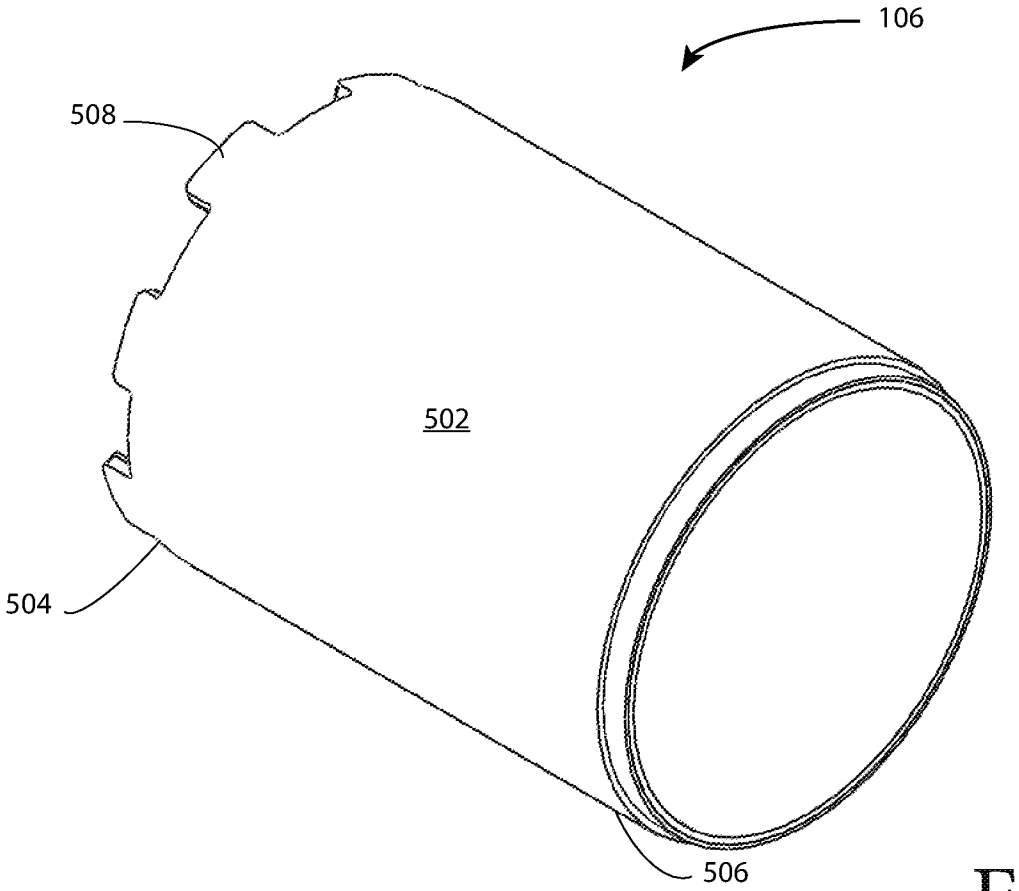
FIG. 5 is a perspective view of a wearable sleeve.
Figure 6:
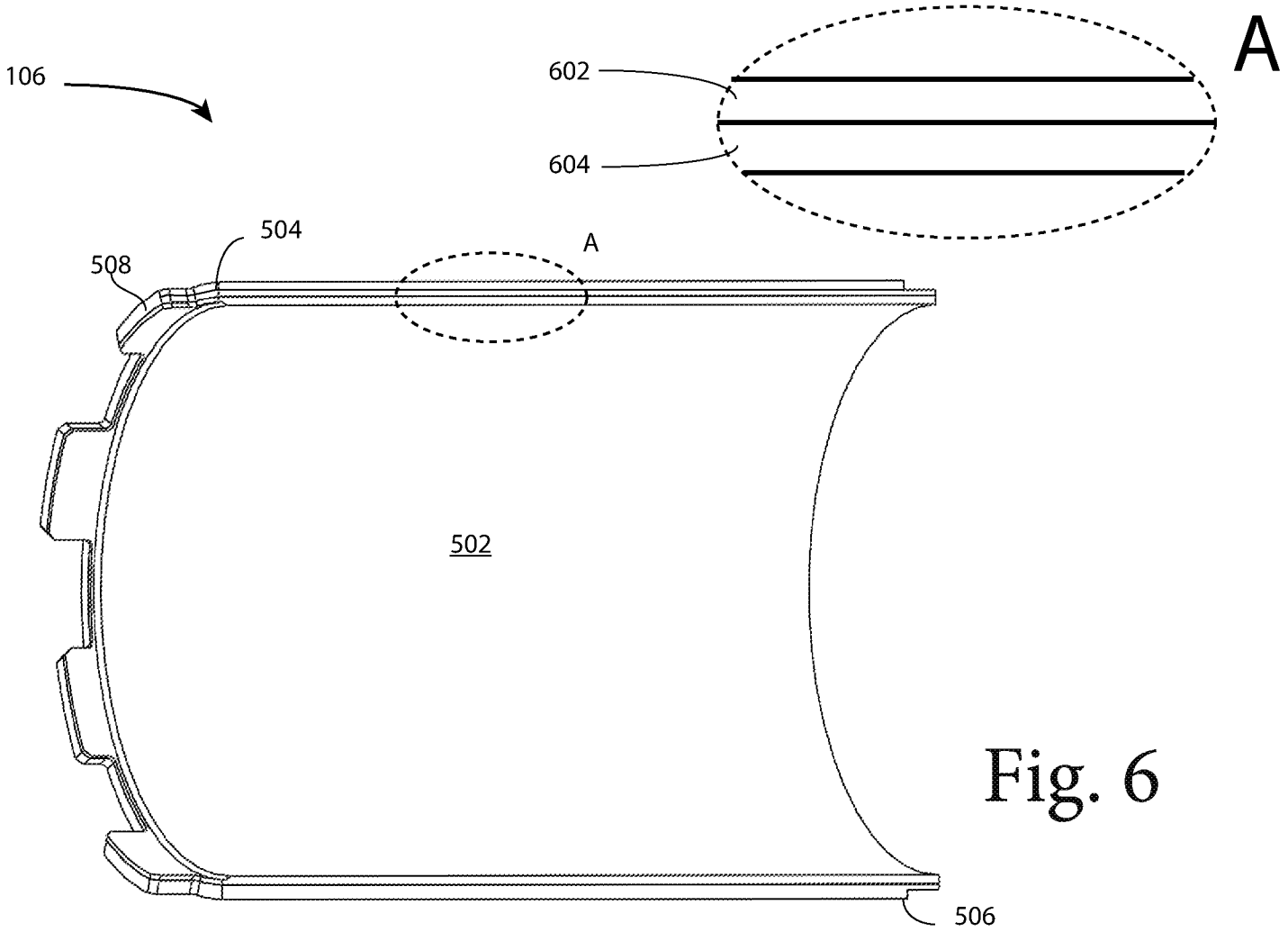
FIG. 6 is a cross-sectional view of the wearable sleeve of FIG. 5.

FIG. 5 is a perspective view of a wearable sleeve and FIG. 6 is a cross-sectional view of the wearable sleeve of FIG. 5. In one more embodiments, the wearable sleeve assembly 106 may not include the metal end rings such as those described above in connection to FIGS. 1-4, but consist of a wearable sleeve alone. As illustrated in FIGS. 5 and 6, a wearable sleeve 502 has a first wearable sleeve end 504 and a second wearable sleeve end 506 opposite the first wearable sleeve end 504. In this embodiment, the first wearable sleeve end 504 has a plurality of azimuthally-spaced locking segments 508, which are similar to and perform a similar function of the locking segments 212 described in connection to FIGS. 1-4. In one or more embodiments, the second wearable sleeve end 506 may also include a plurality of azimuthally-spaced locking segments (not shown), which would be similar to and perform the same functions as the locking segments 212 described in connection to FIGS. 1-4. As illustrated in the highlighted section A of FIG. 6, the wearable sleeve 502 includes a plurality of material layers consisting of the first material layer 602 and second material layer 604. Similar to the material layers described in connection to FIG. 4, the first material layer 602 in FIG. 6 may include wearable material such as chopped fiberglass filled rubber, NBR, VITON® provided by The Chemours Company FC, LLC, or any other like material and the second material layer 604 may include wearable material such as KEVLAR® provided by du Pont de Nemours and Company, polyester, fiberglass or any similar material. The locking segments 508 illustrated in FIGS. 5 and 6 include the plurality of material layers described with respect to the wearable sleeve 502. Further, the first material layer 602 and the second material layer 604 may be made from the same material.

Figure 7B:
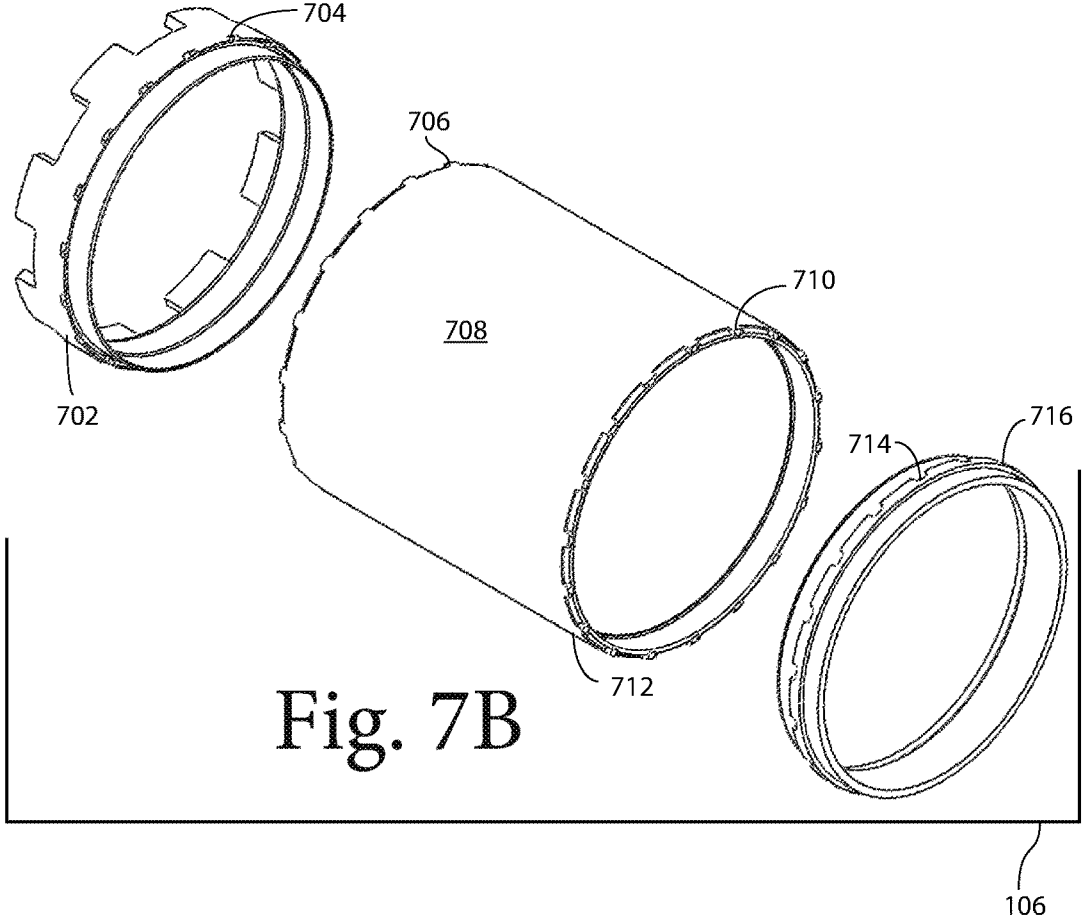
FIG. 7B is an exploded perspective view of the wearable sleeve, the castellated ring, and the seal support of FIG. 7A.
Figure 7A:
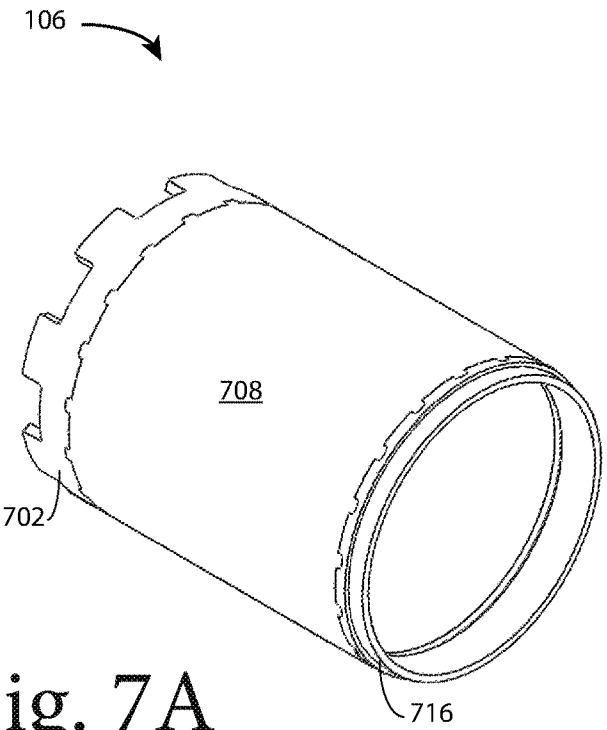
FIG. 7A is a perspective view of a wearable sleeve, a castellated ring, and a seal support.

FIG. 7A is a perspective view of a wearable sleeve, a castellated ring, and a seal support. FIG. 7B is an exploded perspective view of the wearable sleeve, the castellated ring, and the seal support of FIG. 7A. In one or more embodiments, a castellated ring 702, illustrated in FIGS. 7A and 7B, is similar to and performs the same function as the castellated ring 206 described in connection with FIGS. 2-4. In one or more embodiments, the castellated ring 702 is identical to the castellated ring 206 except that azimuthally-spaced locking notches 704 have been cut into the castellated ring 206 without preserving the mating features illustrated in FIGS. 2-4 (i.e., the mating end 402, first groove 404, first inside lip 406, first outside lip 408, and anti-rotation ring 410) in the notched areas. In one or more embodiments, the azimuthally-spaced locking notches 704 include those mating features. In one or more embodiments, the mating features are not included in any part of the castellated ring 702 and instead the azimuthally-spaced locking notches 704 perform the mating function. Although the castellated ring 702 in FIGS. 7A and 7B shows a particular number of locking notches 704, the castellated ring 702 may have a greater or lesser number of locking notches 704 than illustrated.

The locking notches 704 nest with a first set of corresponding locking tabs 706 (only one is labeled) of a wearable sleeve 708, which allows the castellated ring 702 and the wearable sleeve 708 to lock together to avoid slippage of the castellated ring 702 with respect to the wearable sleeve 708. In one or more embodiments, the first set of locking tabs 706 are made from the same material as the wearable sleeve 708. In one or more embodiments, the locking notches 704 and the first set of locking tabs 706 may have different shapes than those illustrated in FIGS. 7A & 7B (i.e., circular shape, hexagonal shape, etc.), but provide the same function of locking the components (i.e., castellated ring 702 and wearable sleeve 708) together.

The wearable sleeve 708 illustrated in FIGS. 7A and 7B includes a second set locking tabs 710 (only one is labeled for simplicity of illustration) opposite the first set of locking tabs 706. The second set of locking tabs 710 are azimuthally-spaced along a second outside lip 712 of the wearable sleeve 708. The second set of locking tabs 710 is similar to and are made from the same material as the locking segments 508 described in connection with FIGS. 5 and 6. The wearable sleeve 710 is made from the same material described in reference to wearable sleeve 200 and 502.

The second set of locking segments 710 nest with corresponding seal support locking notches 714 in a seal support 716. In one or more embodiments, the seal support 716 described in connection with FIGS. 7A and 7B is similar to and performs the same function as the seal support 208 described in connection with FIGS. 2-4. In one or more embodiments, the seal support 716 is identical to the seal support 208 except that the azimuthally-spaced locking notches 714 have been cut into the seal support 716 without preserving the mating features illustrated in FIGS. 2-4 (i.e., first seal ring 412, second groove 414, second inside lip, 416, second outside lip 418, and second seal ring 420) in the notched areas. In one or more embodiments, the azimuthally-spaced seal support locking notches 714 include those mating features. In one or more embodiments, the mating features are not included in any part of the seal support 716 and instead the azimuthally-spaced seal support locking notches 714 perform the mating function. In one or more embodiments, the seal support locking notches 714 and the second set of locking tabs 710 may have different shapes than those illustrated in FIGS. 7A & 7B (i.e., circular shape, hexagonal shape, etc.), but will provide the same function of locking the components (i.e., seal support 716 and wearable sleeve 708) together, which may keep the components from slipping. Although the wearable sleeve 708 and the seal support 716 in FIGS. 7A and 7B shows a particular number of locking tabs 706 and 710 and locking notices 714, the wearable sleeve 708 and seal support 716 may have a greater or lesser number of locking tabs 706 and 710 and locking notches 714 than illustrated.

A different embodiment, described in detail below in connection with FIGS. 8-11, is a multiple piece sleeve design consisting of a metal exterior shell and a composite interior shell. The interior shell is press-fit into the metal exterior shell (by force or thermal shrink) and is aligned by a raised section of the wearable sleeve which is sized and angled to cover, for example, an underlying antenna coil in the tubular. The geometry of the raised section shown in FIGS. 8-11 is of a 45° tilt angle antenna of a 4 inch or 6 inch outside diameter. However, the geometry of the sleeve can be modified to sit over any continuous wound antenna shape. The metal exterior shell can also have additional axial slits, discussed below, which reduce eddy currents that form because of antenna excitation.

Figure 8:
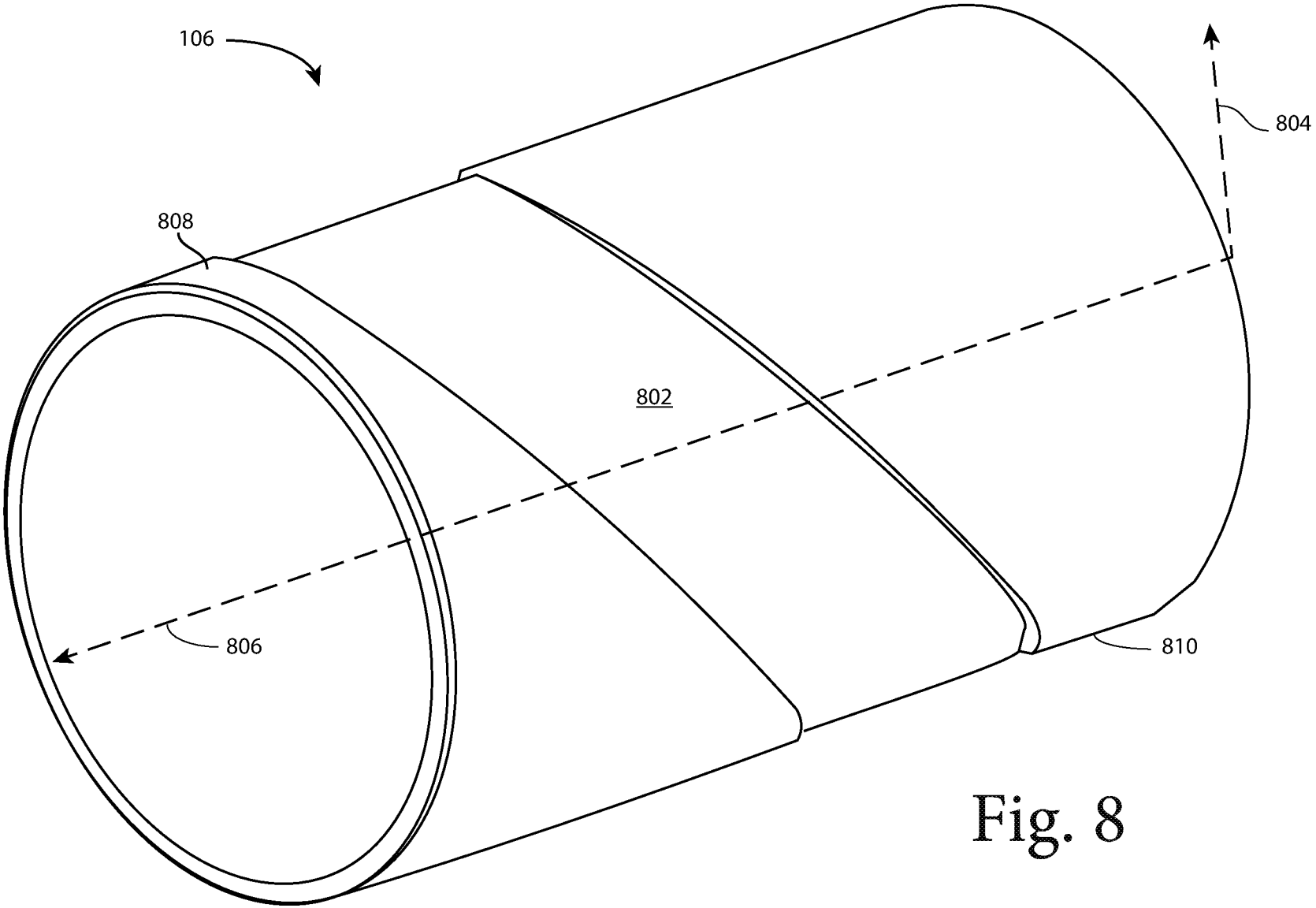
FIG. 8 is a perspective view of a wearable sleeve, a first coupling, and a second coupling.

FIG. 8 is a perspective view of a wearable sleeve, a first coupling, and a second coupling. In this embodiment of the wearable sleeve assembly 106, metal end rings are not sealed to a wearable sleeve 802 in such a way to restrict fluid from entering the wearable sleeve 802 and accessing the vulnerable portions 108 of the bottom hole assembly 100, but are coupled in a way to allow fluid to enter underneath the wearable sleeve 802. Allowing fluid to freely enter underneath the wearable sleeve 802 allows for the compensation of hydrostatic pressure on the wearable sleeve 802 (i.e., hoop stress). In this embodiment, the wearable sleeve 802 has an axial axis 804 and a longitudinal axis 806 substantially perpendicular (i.e., within 1, 5, or 10 degrees) to the axial axis 804. The wearable sleeve 802 includes a first coupling 808 and a second coupling 810, which are coupled to the wearable sleeve 802.

Figure 9:
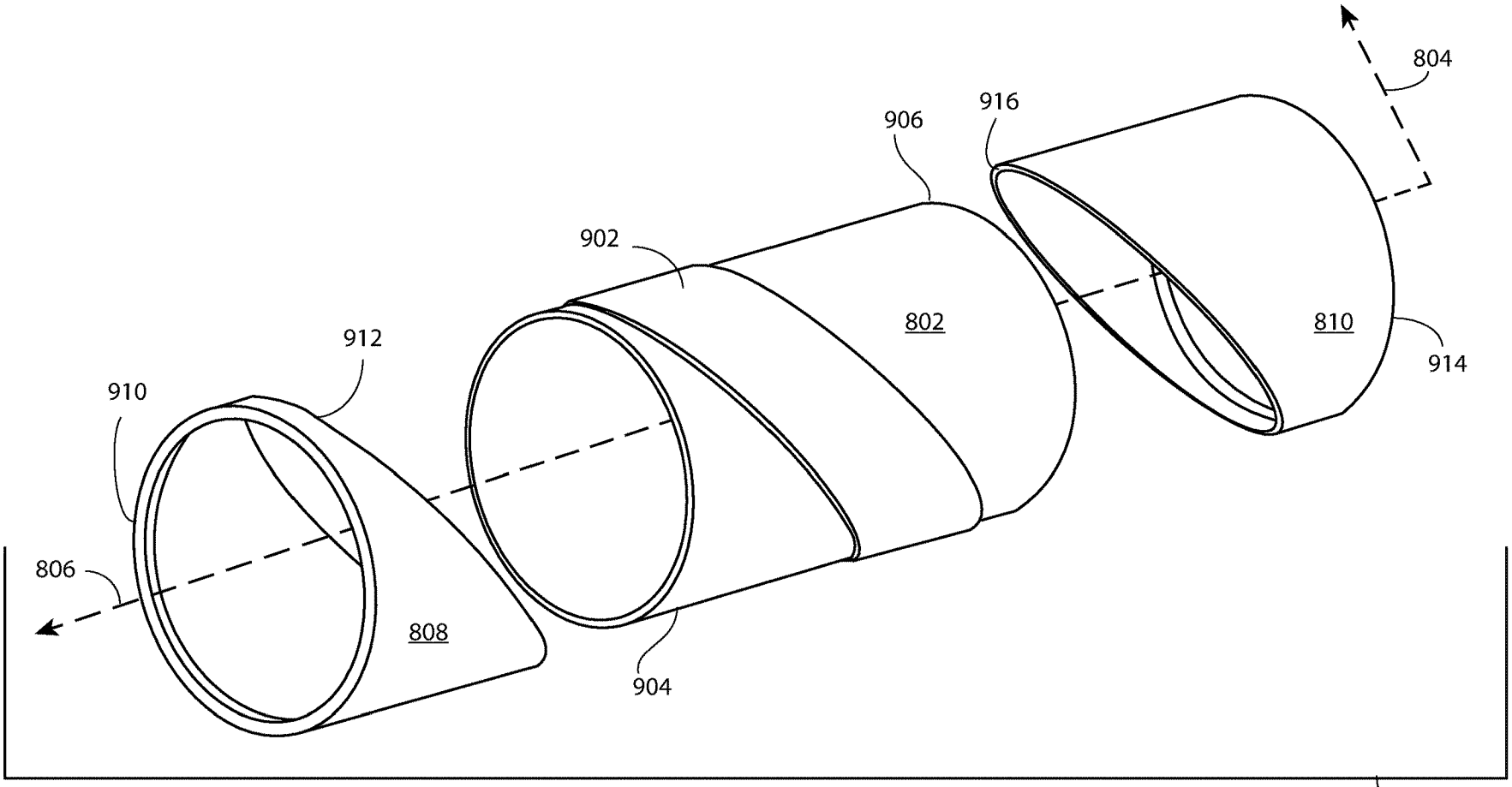
FIG. 9 is an exploded perspective view of the wearable sleeve, the composite band segment, the first coupling, and the second coupling of FIG. 8.
Figure 10:
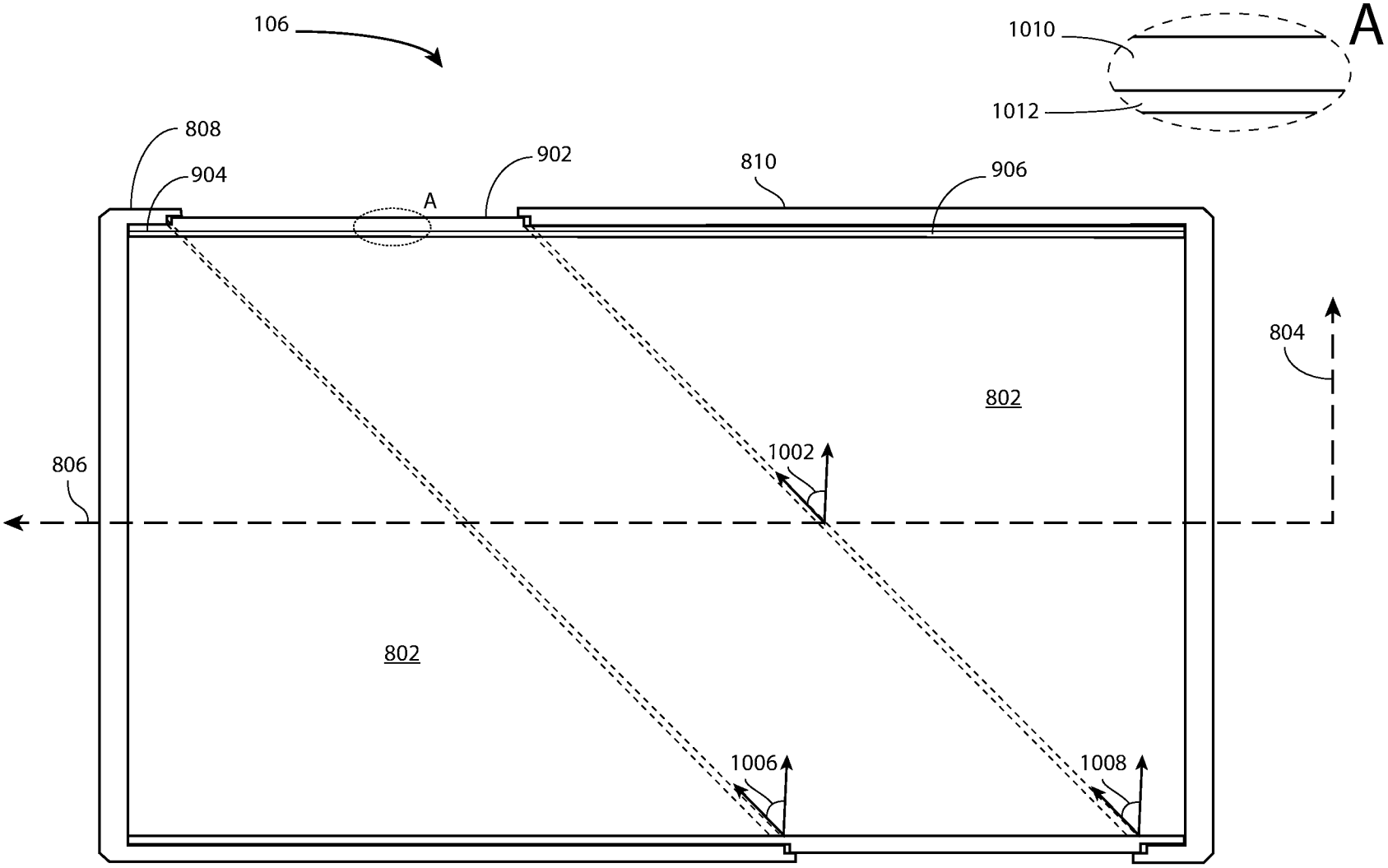
FIG. 10 is a cross-sectional view of the wearable sleeve, the composite band segment, the first coupling, and the second coupling of FIG. 8.

FIG. 9 is an exploded perspective view of the wearable sleeve, the composite band segment, the first coupling, and the second coupling of FIG. 8. FIG. 10 is a cross-sectional view of the wearable sleeve, the composite band segment, the first coupling, and the second coupling of FIG. 8. In one or more embodiments, the wearable sleeve 802 may include a composite band segment 902 which is the raised section of the wearable sleeve 802 which is intended to be aligned with the location of the antenna coil in an underlying tool. The composite band segment 902 may be made from the same or similar material as is used to make the wearable sleeve 200, 502, and 708 described in connection with FIGS. 2-10. As shown in FIGS. 9 and 10, the composite band segment 902 is azimuthally-wrapped around the longitudinal axis 806 at a composite band segment angle 1002 with respect to the axial axis 804. In one or more embodiments, the composite band segment 902 may be integral to the wearable sleeve 802 or a separate element that is wrapped around the wearable sleeve 802 and coupled between the first coupling 808 and second coupling 810. The wearable sleeve 802 includes a first interference end 904 and a second interference end 906 opposite the first interference end 904.

As illustrated in FIG. 9, the wearable sleeve 802 is couplable to the first coupling 808. In one or more embodiments, the first coupling 808 is coupled to the first interference end 904 of the wearable sleeve 802 and sealed such as by use of an adhesion promoter. The first coupling 808 includes a first surface 910. The first surface 910 of the first coupling 808 is substantially parallel to the axial axis 804 (i.e., within 1, 5, or 10 degrees). The first coupling 808 includes a first interference surface 912. The first interference surface 912 makes a first interference surface angle 1006 with respect to the axial axis 804. In one or more embodiments, the first interference surface 912 is substantially parallel to the axial axis 804 (i.e., within 1, 5, or 10 degrees).

The wearable sleeve 802 is couplable to the second coupling 810. In one or more embodiments, the second coupling 810 is coupled to the second interference end 906 of the wearable sleeve 802 and sealed such as by use of an adhesion promoter. The second coupling 810 includes a second surface 914. The second surface 914 of the second coupling 810 is substantially parallel to the axial axis 804 (i.e., within 1, 5, or 10 degrees). The second coupling 810 includes a second interference surface 916. The second interference surface 916 has a second interference surface angle 1008 with respect to the axial axis 804. In one or more embodiments, the second interference surface 916 is substantially parallel to the axial axis 804 (i.e., within 1, 5, or 10 degrees).

As illustrated in FIG. 10, the first interference angle 1006, the second interference angle 1008 and the composite band segment angle 1002 have substantially the same value (i.e., within 1, 5, or 10 degrees). Alternatively, in one or more embodiments the first interference angle 1006 and the second interference angle 1008 have different values.

Similar to the wearable band 200, 502, and 708 described in connection with FIGS. 1-7B, the wearable band 802 described in connection with FIGS. 8-10 may include a plurality of material layers. As illustrated in the highlighted section A of FIG. 10, the wearable sleeve 802 includes a plurality of material layers consisting of a first material layer 1010 and second material layer 1012. Similar to the material layers described above, the first material layer 1010 may include wearable material such as chopped fiberglass filled rubber, NBR, VITON® provided by The Chemours Company FC, LLC, or any other like material and the second material layer 1012 may include wearable material such as KEVLAR® provided by du Pont de Nemours and Company, polyester, fiberglass, or any similar material. Further, the first material layer 1010 and the second material layer 1012 may be made from the same material.

Figure 11:
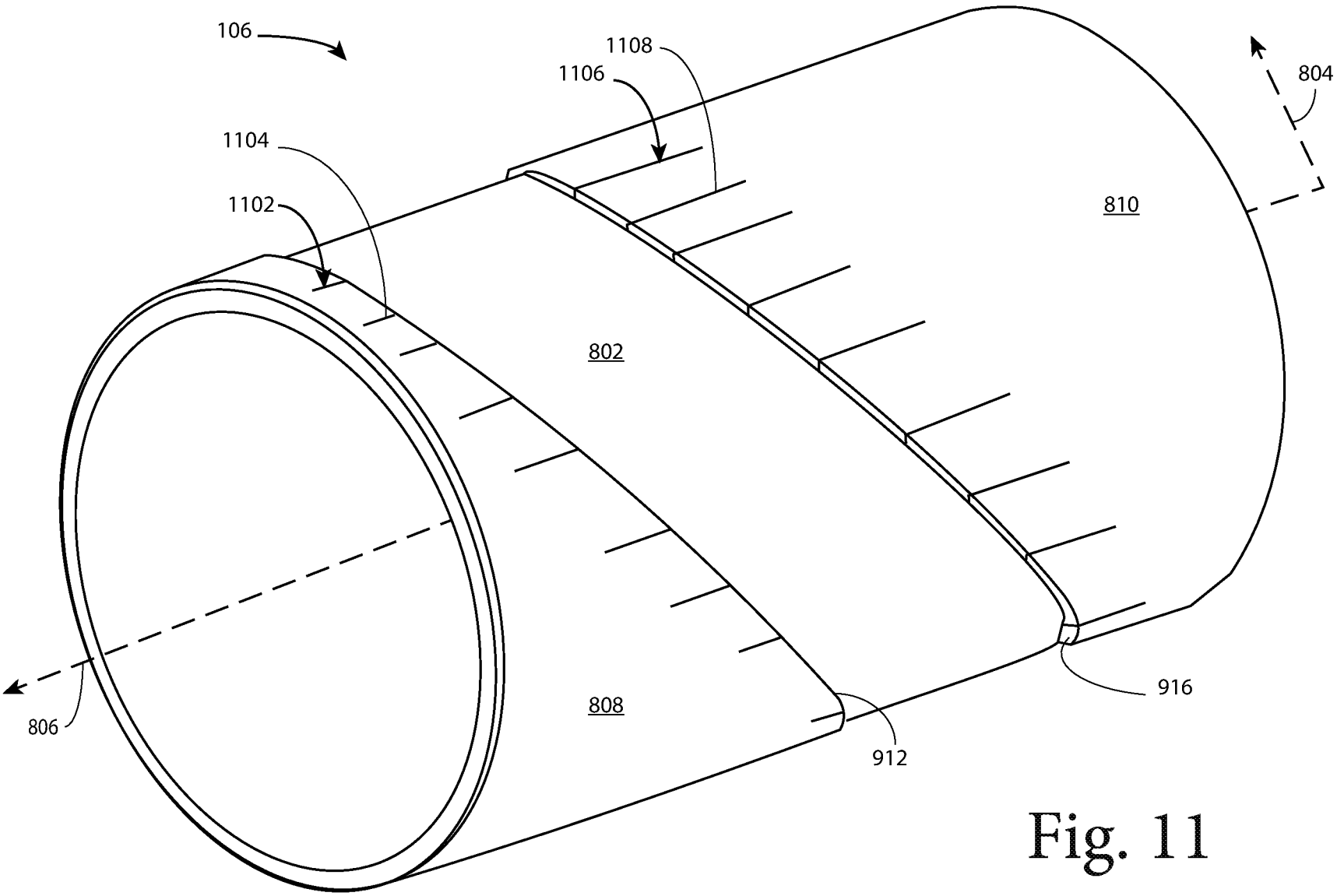
FIG. 11 is perspective view of a wearable band having eddy current defeating features.

FIG. 11 is a perspective view of a wearable band having eddy current defeating features. In one more embodiments, the first interference surface 912 of the first coupling 808 has a first eddy current defeating feature 1102. The first eddy current defeating feature 1102 may include a plurality of azimuthally-spaced cuts 1104 (only one of the azimuthally-spaced cuts is labeled) positioned about the longitudinal axis 806. Further, the second interference surface 916 of the second coupling 810 has a second eddy current defeating feature 1106. The second eddy current defeating 1106 feature may include a plurality of azimuthally-spaced cuts 1108 (only one of the azimuthally-paced cuts is labeled) positioned about the longitudinal axis 806.

Figure 12:
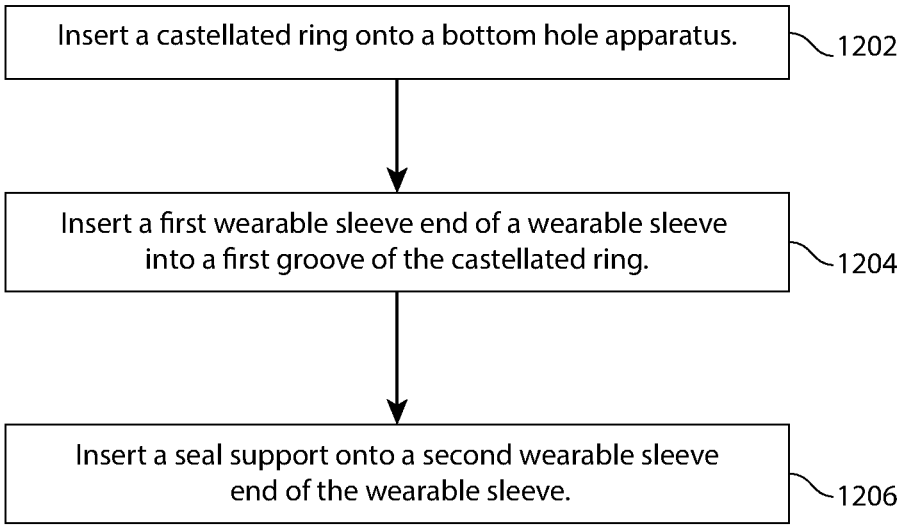
FIG. 12 is a flow chart showing a method for assembling the wearable sleeve, the castellated ring, and the seal support of FIG. 2.

FIG. 12 is a flow chart showing a method for assembling the wearable sleeve, castellated ring, and seal support of FIG. 2. The process includes inserting a castellated ring (such as castellated ring 206) onto a bottom hole apparatus (such as bottom hole apparatus 100) (block 1202). The first wearable sleeve end (such as first wearable sleeve end 202) is inserted into a first groove (such as first groove 404) of the castellated ring (such as castellated ring 206) (block 1204). A seal support (such as seal support 208) is inserted onto a second wearable sleeve (such as second wearable sleeve end 204) of the wearable sleeve (such as wearable sleeve 106) (block 1206).

Figure 13:
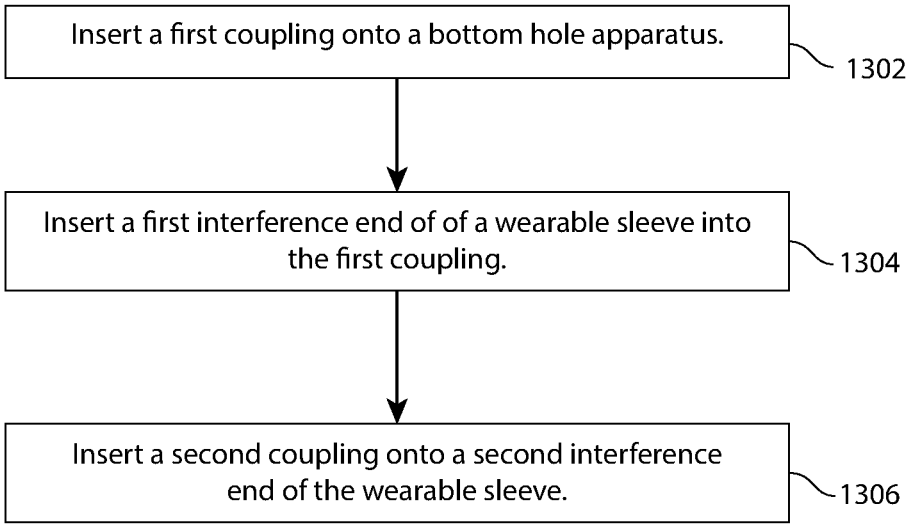
FIG. 13 is a flow chart showing a method for assembling the wearable sleeve, the composite band segment, the first coupling, and the second coupling of FIGS. 8-11.

FIG. 13 is a flow chart showing a method for assembling the wearable sleeve, composite band segment, first coupling and second coupling of FIG. 7. The process includes inserting a first coupling (such as first coupling 808) onto a bottom hole apparatus (such as bottom hole apparatus 100) (block 1302). A first interference end (such as first interference end 906) of a wearable sleeve (such as wearable sleeve 802) is inserted into the first coupling (such as first coupling 808) (block 1304). A second coupling (such as second coupling 810) is coupled onto a second interference end (such as second interference end 916) of the wearable sleeve (such as wearable sleeve 802) (block 1306).

In one aspect an apparatus includes a wearable sleeve for covering a vulnerable portion of a bottom hole apparatus. The wearable sleeve has a first wearable sleeve end and a second wearable sleeve end opposite the first wearable sleeve end. A castellated ring is coupled to the first wearable sleeve end. The castellated ring has a castellated end. The castellated end has a plurality of azimuthally-spaced locking segments and a mating end opposite the castellated end. The mating end has a first groove facing away from the castellated end. The first groove has a first inside lip and a first outside lip. The castellated ring has an anti-rotation ring integral to the first inside lip of the first groove and friction coupled to the first wearable sleeve end such that the first groove accepts the first wearable sleeve end and the anti-rotation ring seals against the first wearable sleeve end. The apparatus includes a seal support coupled to the second wearable sleeve end. The seal support has a first seal ring. The first seal ring has a second groove facing towards the second wearable sleeve end. The second groove has a second inside lip and a second outside lip. The seal support includes a second seal ring integral to the second inside lip of the second groove and friction coupled to the second wearable sleeve end such that the second groove accepts the second wearable sleeve end and the second seal ring seals against the second wearable sleeve end.

Implementation may include one or more of the following. The wearable sleeve may include a first material layer; and a second material layer overlaid on the first material layer. The first material layer may be made from a material selected from a group consisting of chopped fiberglass filled rubber, nitrile rubber, and Viton. The second material layer may be made from a material selected from a group consisting of Kevlar, polyester, and fiberglass. The first material layer and second material layer may be made from the same material. The castellated ring may include a plurality of azimuthally-spaced locking notches. The first wearable sleeve end may include a plurality of azimuthally-spaced locking tabs. The second wearable sleeve end may include a plurality of azimuthally-spaced locking tabs. The seal support may include a plurality of azimuthally-spaced seal support locking notches. The first wearable sleeve end may include a first wearable sleeve end lip. The first wearable sleeve end may include a first wearable sleeve end rim. The second wearable sleeve end may include a second wearable sleeve end lip. The second wearable sleeve end may include a second wearable sleeve end rim. The first wearable sleeve end may include a first wearable sleeve end lip. The first wearable sleeve end may include a first wearable sleeve end rim. The second wearable sleeve end may include a second wearable sleeve end lip. The second wearable sleeve end may include a second wearable sleeve end rim.

In one aspect, an apparatus includes a wearable sleeve for covering a vulnerable portion of a bottom hole apparatus. The wearable sleeve includes a first wearable sleeve end having a plurality of azimuthally-spaced locking segments. The wearable sleeve includes a second wearable sleeve end opposite the first wearable sleeve end, and a plurality of material layers. The plurality of material layers includes a first material layer; and a second material layer overlaid on the first material layer.

Implementation may include one or more of the following. The first material layer may be made from a material selected from a group consisting of chopped fiberglass filled rubber, nitrile rubber, and Viton®. The second material layer may be made from a material selected from a group consisting of Kevlar™, polyester, and fiberglass. The first layer of material and second layer of material may be made from the same material.

In one aspect, an apparatus includes a wearable sleeve for covering a vulnerable portion of a bottom hole apparatus. The wearable sleeve includes an axial axis, and a longitudinal axis substantially perpendicular to the axial axis. The wearable sleeve includes a first interference end, and a second interference end opposite the first interference end. The apparatus includes a first coupling coupled to the first interference end of the wearable sleeve. The first coupling includes a first surface substantially parallel to the axial axis, and a first interference surface having a first interference surface angle with respect to the axial axis. The apparatus includes a second coupling coupled to the second interference end of the wearable sleeve. The second coupling includes a second surface substantially parallel to the axial axis, and a second interference surface having a second interference surface angle with respect to the axial axis.

Implementation may include one or more of the following. The wearable sleeve may include a composite band segment azimuthally wrapped around the longitudinal axis at a composite band segment angle with respect to the axial axis. The first interference angle, the second interference angle, and the composite band segment angle may be the same. The first interference angle may equal the second interference angle. The wearable sleeve may include a first material layer, and a second material layer overlaid on the first material layer. The first material layer may be made from a material selected from a group consisting of chopped fiberglass filled rubber, nitrile rubber, and Viton. The second material layer may be made from a material selected from a group consisting of Kevlar, polyester, and fiberglass. The first layer of material and second layer of material may be made from the same material. The first interference surface may have a first eddy current defeating feature. The first eddy current defeating feature may have a plurality of azimuthally-spaced cuts positioned about the longitudinal axis. The second interference surface may have a second eddy current defeating feature. The second eddy current defeating feature may have a plurality of azimuthally-spaced cuts positioned about the longitudinal axis.

In one aspect, a method includes inserting a castellated ring onto a bottom hole apparatus. The castellated ring has a castellated end. The castellated end has a plurality of azimuthally-spaced locking segments for locking the castellated end onto the bottom hole apparatus. The castellated ring has a mating end opposite the castellated end. The mating end has a first groove facing away from the castellated end. The first groove has a first inside lip and a first outside lip. The castellated ring has an anti-rotation ring integral to the first inside lip of the first groove and friction coupled to a first wearable sleeve end of a wearable sleeve such that the first groove accepts the first wearable sleeve end and the anti-rotation ring seals against the first wearable sleeve end. The first wearable sleeve end of the wearable sleeve inserted into the first groove to cover a vulnerable portion of the bottom hole apparatus. The wearable sleeve has a second wearable sleeve end opposite the first wearable sleeve end. A seal support is inserted onto the second wearable sleeve end. The seal support has a first seal ring. The first seal ring has a second groove facing towards the second wearable sleeve end. The second groove has a second inside lip and a second outside lip. The seal support has a second seal ring integral to the second inside lip of the second groove and friction coupled to the second wearable sleeve end such that the second groove accepts the second wearable sleeve end and the second seal ring seals against the second wearable sleeve end.

Implementation may include one or more of the following. The castellated ring may be chemically bonded to the wearable sleeve. The seal support may be chemically bonded to the wearable sleeve. The wearable sleeve may include a first material layer and a second material layer overlaid on the first material layer. The first material layer may be made from a material selected from a group consisting of chopped fiberglass filled rubber, nitrile rubber, and Viton. The second material layer may be made from a material selected from a group consisting of Kevlar, polyester, and fiberglass. The first material layer and second material layer may be made from the same material. The castellated ring may include a plurality of azimuthally-spaced locking notches. The first wearable sleeve end may include a plurality of azimuthally-spaced locking tabs. The second wearable sleeve end may include a plurality of azimuthally-spaced locking tabs. The seal support may include a plurality of azimuthally-spaced seal support locking notches. The first wearable sleeve end may include a first wearable sleeve end lip. The first wearable sleeve end may include a first wearable sleeve end rim. The second wearable sleeve end may include a second wearable sleeve end lip. The second wearable sleeve end may include a second wearable sleeve end rim. The first wearable sleeve end may include a first wearable sleeve end lip. The first wearable sleeve end may include a first wearable sleeve end rim. The second wearable sleeve end may include a second wearable sleeve end lip. The second wearable sleeve end may include a second wearable sleeve end rim. The first wearable sleeve end may include a first wearable sleeve end lip. The first wearable sleeve end may include a first wearable sleeve end rim. The second wearable sleeve end may include a second wearable sleeve end lip. The second wearable sleeve end may include a second wearable sleeve end rim.

In one aspect, a method includes inserting a first coupling onto a bottom hole apparatus. The first coupling has an axial axis, and a longitudinal axis substantially perpendicular to the axial axis. The first coupling has a first surface substantially parallel to the axial axis and a first interference surface. The first interference has a first interference surface angle with respect to the axial axis. A first interference end of a wearable sleeve to cover a vulnerable portion of the bottom hole apparatus is inserted into the first coupling. The wearable sleeve has a second interference end opposite the first interference end. A second coupling is inserted onto to a second interference end of the wearable sleeve. The second coupling has a second surface substantially parallel to the axial axis and a second interference surface having a second interference surface angle with respect to the axial axis.

Implementation may include one or more of the following. The first interference end may be sealed to the first coupling. The second interference end may be sealed to the second coupling. The wearable sleeve may include a composite band segment azimuthally wrapped around the longitudinal axis at a composite band segment angle with respect to the axial axis. The first interference angle, the second interference angle, and the composite band segment angle may be the same. The first interference angle may equal the second interference angle. The wearable sleeve may include a first material layer; and a second material layer overlaid on the first material layer. The first material layer may be made from a material selected from a group consisting of chopped fiberglass filled rubber, nitrile rubber, and Viton. The second material layer may be made from a material selected from a group consisting of Kevlar, polyester, and fiberglass. The first layer of material and second layer of material may be made from the same material. The first interference surface may have a first eddy current defeating feature. The first eddy current defeating feature may have a plurality of azimuthally-spaced cuts positioned about the longitudinal axis. The second interference surface may have a second eddy current defeating feature. The second eddy current defeating feature may have a plurality of azimuthally-spaced cuts positioned about the longitudinal axis.

The operations of the flow diagrams are described with references to the systems/apparatus shown in the block diagrams. However, it should be understood that the operations of the flow diagrams could be performed by embodiments of systems and apparatus other than those discussed with reference to the block diagrams, and embodiments discussed with reference to the systems/apparatus could perform operations different than those discussed with reference to the flow diagrams.

The word "coupled" herein means a direct connection or an indirect connection.

The text above describes one or more specific embodiments of a broader invention. The invention also is carried out in a variety of alternate embodiments and thus is not limited to those described here. The foregoing description of an embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. An apparatus comprising:

a wearable sleeve to protect a vulnerable portion of a downhole tool, the wearable sleeve comprising:

a first material layer, wherein the first material layer is made from a first material selected from a group consisting of chopped fiberglass filled rubber, nitrile butadiene rubber, and fluoroelastomers; and a second material layer overlaid on the first material layer, wherein the second material layer is made from a second material selected from a group consisting of polyparaphenylene terephthalamide, polyester, and fiberglass;

wherein the first material layer is made from the first material that is different from the second material used to make the second material layer;

an axial axis;

a longitudinal axis substantially perpendicular to the axial axis;

a first wearable sleeve end; and a second wearable sleeve end opposite the first wearable sleeve end;

a first ring coupled to the first wearable sleeve end; and a second ring coupled to the second wearable sleeve end;

wherein the first ring and the second ring have the same expansion properties as the downhole tool.

2. The apparatus of claim 1 wherein the downhole tool is made of a metal and the first ring and the second ring are made from the same metal.

3. The apparatus of claim 1 wherein the vulnerable portion is an antenna.

4. The apparatus of claim 1 wherein:

the first ring has:

a first surface substantially parallel to the axial axis, and a first interference surface having a first interference surface angle with respect to the axial axis; and the second ring has:

a second surface substantially parallel to the axial axis, and a second interference surface having a second interference surface angle with respect to the axial axis;

wherein the wearable sleeve comprises a composite band segment azimuthally wrapped around the longitudinal axis at a composite band segment angle with respect to the axial axis.

5. The apparatus of claim 4 wherein the first interference surface has a first eddy current defeating feature.

6. The apparatus of claim 4 wherein the second interference surface has a second eddy current defeating feature.

7. The apparatus of claim 1 wherein the first ring and the second ring have a plurality of azimuthally spaced locking notches.

8. The apparatus of claim 1 wherein the first wearable sleeve end and the second wearable sleeve end have a plurality of azimuthally-spaced locking tabs.

9. The apparatus of claim 1 wherein the first ring and the second ring sealingly engage the downhole tool and expand at a same rate as the downhole tool under temperature.

10. An apparatus comprising:

a wearable sleeve to protect a vulnerable portion of a downhole tool, the wearable sleeve having:

an axial axis;

a longitudinal axis substantially perpendicular to the axial axis;

a first wearable sleeve end; and a second wearable sleeve end opposite the first wearable sleeve end;

a first ring coupled to the first wearable sleeve end; and a second ring coupled to the second wearable sleeve end;

wherein the first ring and the second ring have the same expansion properties as the downhole tool, wherein:

the first ring has:

a castellated end having a plurality of azimuthally-spaced locking segments;

a mating end opposite the castellated end, the mating end having:

a first groove facing away from the castellated end, the first groove having a first inside lip and a first outside lip;

an anti-rotation ring integral to the first inside lip of the first groove and friction coupled to the first wearable sleeve end such that the first groove accepts the first wearable sleeve end and the anti-rotation ring seals against the first wearable sleeve end; and the second ring has:

a first seal ring having a second groove facing towards the second wearable sleeve end; the second groove having a second inside lip and a second outside lip; and a second seal ring integral to the second inside lip of the second groove and friction coupled to the second wearable sleeve end such that the second groove accepts the second wearable sleeve end and the second seal ring seals against the second wearable sleeve end.

11. The apparatus of claim 10 wherein the wearable sleeve comprises:

a first material layer; and a second material layer overlaid on the first material layer;

wherein the first material layer is made from a first material that is different from a second material used to make the second material layer.

12. The apparatus of claim 11 wherein the first material layer is made from the first material selected from a group consisting of chopped fiberglass filled rubber, nitrile butadiene rubber, and fluoroelastomers and the second material layer is made from the second material selected from a group consisting of polyparaphenylene terephthalamide, polyester, and fiberglass.

13. The apparatus of claim 10 wherein the first wearable sleeve end has a plurality of azimuthally-spaced locking segments.

14. The apparatus of claim 10 wherein the first ring and the second ring sealingly engage the downhole tool and expand at a same rate as the downhole tool under temperature.

15. An apparatus comprising:

a wearable sleeve to protect a vulnerable portion of a downhole tool, the wearable sleeve having:

an axial axis;

a longitudinal axis substantially perpendicular to the axial axis;

a first interference end; and a second interference end opposite the first interference end;

a first ring coupled to the first interference end of the wearable sleeve, the first ring having:

a first surface substantially parallel to the axial axis; and a first interference surface having a first interference surface angle with respect to the axial axis; and a second ring coupled to the second interference end of the wearable sleeve, the second ring having:

a second surface substantially parallel to the axial axis; and a second interference surface having a second interference surface angle with respect to the axial axis, wherein the first interference surface has a first eddy current defeating feature or the second interference surface has a second eddy current defeating feature.

16. The apparatus of claim 15 wherein the wearable sleeve comprises a composite band segment azimuthally wrapped around the longitudinal axis at a composite band segment angle with respect to the axial axis.

17. The apparatus of claim 16 wherein the first interference angle, the second interference angle, and the composite band segment angle are the same.

18. The apparatus of claim 15 wherein the first interference angle equals the second interference angle.

19. The apparatus of claim 15 wherein the wearable sleeve comprises:

a first material layer; and a second material layer overlaid on the first material layer;

wherein the first material layer is made from a first material that is different from a second material used to make the second material layer.

20. The apparatus of claim 19 wherein the first material layer is made from the first material selected from a group consisting of chopped fiberglass filled rubber, nitrile butadiene rubber, and fluoroelastomers and the second material layer is made from the second material selected from a group consisting of polyparaphenylene terephthalamide, polyester, and fiberglass.

21. The apparatus of claim 15 wherein the first ring and the second ring sealingly engage the downhole tool and expand at a same rate as the downhole tool under temperature.

22. An apparatus comprising:

a wearable sleeve to protect a sensor coupled to an object, the wearable sleeve having:

a first wearable sleeve end;

a second wearable sleeve end opposite the first wearable sleeve end; and a plurality of material layers having:

a first material layer, wherein the first material layer is made from a first material selected from a group consisting of chopped fiberglass filled rubber, nitrile butadiene rubber, and fluoroelastomers;

a second material layer overlaid on the first material layer, wherein the second material layer is made from a second material selected from a group consisting of polyparaphenylene terephthalamide, polyester, and fiberglass;

wherein the first material layer is made from the first material that is different from the second material used to make the second material layer; and wherein the first wearable sleeve end has a plurality of azimuthally-spaced locking segments.

23. An apparatus comprising:

a wearable sleeve to protect a vulnerable portion of a downhole tool, the wearable sleeve having:

an axial axis;

a longitudinal axis substantially perpendicular to the axial axis;

a first interference end; and a second interference end opposite the first interference end;

a first ring coupled to the first interference end of the wearable sleeve, the first ring having:

a first surface substantially parallel to the axial axis; and a first interference surface having a first interference surface angle with respect to the axial axis; and a second ring coupled to the second interference end of the wearable sleeve, the second ring having:

a second surface substantially parallel to the axial axis; and a second interference surface having a second interference surface angle with respect to the axial axis, wherein the wearable sleeve comprises a first material layer and a second material layer overlaid on the first material layer;

wherein the first material layer is made from a first material that is different from a second material used to make the second material layer, and wherein the first material layer is made from the first material selected from a group consisting of chopped fiberglass filled rubber, nitrile butadiene rubber, and fluoroelastomers and the second material layer is made from the second material selected from a group consisting of polyparaphenylene terephthalamide, polyester, and fiberglass.

* * * * *